US010442184B2

(12) United States Patent
Espinar Lacueva et al.

(10) Patent No.: US 10,442,184 B2
(45) Date of Patent: Oct. 15, 2019

(54) DRYERS FOR PRINTED MEDIA

(71) Applicants: HEWLETT-PACKARD DEVELOPMENT COMPANY, L.P., Houston, TX (US); Nuria Espinar Lacueva, Igualada (ES); Eduardo Martin Orue, Sabadell (ES); Alberto Arredondo, Sant Cugat del Valles (ES)

(72) Inventors: Nuria Espinar Lacueva, Igualada (ES); Eduardo Martin Orue, Sabadell (ES); Alberto Arredondo, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/546,775

(22) PCT Filed: Apr. 30, 2015

(86) PCT No.: PCT/EP2015/059570
§ 371 (c)(1),
(2) Date: Jul. 27, 2017

(87) PCT Pub. No.: WO2016/173671
PCT Pub. Date: Nov. 3, 2016

(65) Prior Publication Data

US 2018/0022082 A1 Jan. 25, 2018

(51) Int. Cl.
*B41F 23/04* (2006.01)
*B41J 11/00* (2006.01)
(Continued)

(52) U.S. Cl.
CPC ..... *B41F 23/0426* (2013.01); *B41F 23/0466* (2013.01); *B41J 11/002* (2013.01); *F26B 13/00* (2013.01); *F26B 21/004* (2013.01)

(58) Field of Classification Search
CPC ..... B41F 23/0426
(Continued)

(56) References Cited

U.S. PATENT DOCUMENTS 927,995 A 7/1909 Morrow
1,737,015 A * 11/1929 Merrill ..... F26B 13/104 34/229
(Continued)

FOREIGN PATENT DOCUMENTS

CN 87102595 1/1988
CN 208629231 6/2014
(Continued)

OTHER PUBLICATIONS

Steinberg, Neil I., A Bunch of Hot Air, Apr. 30, 2006 (5 pages).

*Primary Examiner* — Anthony H Nguyen
(74) *Attorney, Agent, or Firm* — HP Inc. Patent Department

(57) ABSTRACT

Dryers (300) comprising a first surface (102) and a deflector (302). The first surface comprises at least one opening (104) through which air is forced during use to dry a printed media and the deflector comprises (302) a second surface to change the direction of airflow passing through the at least one opening. The deflector guides the direction of the airflow such that it flows substantially in a direction corresponding to the direction of travel (310) of the printed media.

20 Claims, 7 Drawing Sheets

(51) Int. Cl.
*F26B 13/00* (2006.01)
*F26B 21/00* (2006.01)

(58) Field of Classification Search
USPC ..... 101/424.1
See application file for complete search history.

(56) References Cited

U.S. PATENT DOCUMENTS 3,287,821 A 11/1966 Schregenberger
3,538,834 A * 11/1970 Tatsuo ..... G03D 5/067 34/638
5,092,696 A * 3/1992 Armiroli ..... B41J 15/046 101/417
5,590,480 A 1/1997 Bria et al.
5,717,446 A * 2/1998 Teumer ..... B41J 2/01 347/102
6,018,886 A * 2/2000 Bell ..... F26B 13/10 34/380
6,038,998 A * 3/2000 Platsch ..... B41F 23/06 101/416.1
6,244,700 B1 * 6/2001 Kimura ..... B41J 11/002 347/102
6,484,418 B1 11/2002 Hada et al.
6,598,315 B1 7/2003 Heikkila et al.
8,770,738 B2 7/2014 Shifley et al.
2004/0061758 A1 * 4/2004 Patterson ..... B41J 11/002 347/102
2005/0150130 A1 * 7/2005 Fellinghann ..... B41J 11/002 34/624
2005/0241519 A1 * 11/2005 Aylor ..... B41F 23/0409 101/488
2011/0078883 A1 * 4/2011 Muenstermann ..... D04H 18/04 28/104
2014/0237848 A1 8/2014 Walker et al.

FOREIGN PATENT DOCUMENTS

JP 2013193252 9/2013
JP 2014102010 6/2014
JP 2015054437 3/2015

* cited by examiner

DRYERS FOR PRINTED MEDIA

BACKGROUND

When drying printed media, such as ink on paper, dryers that impinge hot air at high speed are sometimes used. The impact of the hot air against the printed surface dries the media. These types of dryers may be used, for example, in printers.

In some examples the hot air can be forced through an opening in the dryer.

BRIEF DESCRIPTION OF DRAWINGS

Examples will now be described, by way of non-limiting example, with reference to the accompanying drawings, in which.

DETAILED DESCRIPTION

As described above, when drying printed media, dryers may be used that dry by impinging hot air at high speed on to the printed media. In some examples, the media may be a lamina material or two dimensional sheet. For example, the media may be paper, webbing, fabric, plastic sheeting or any other media suitable for printing. In some examples the media may be printed by applying an agent to the media, for example, ink, dye or an adhesive such as glue. The combination of agent on media is referred to herein as printed media.

Figure 1:
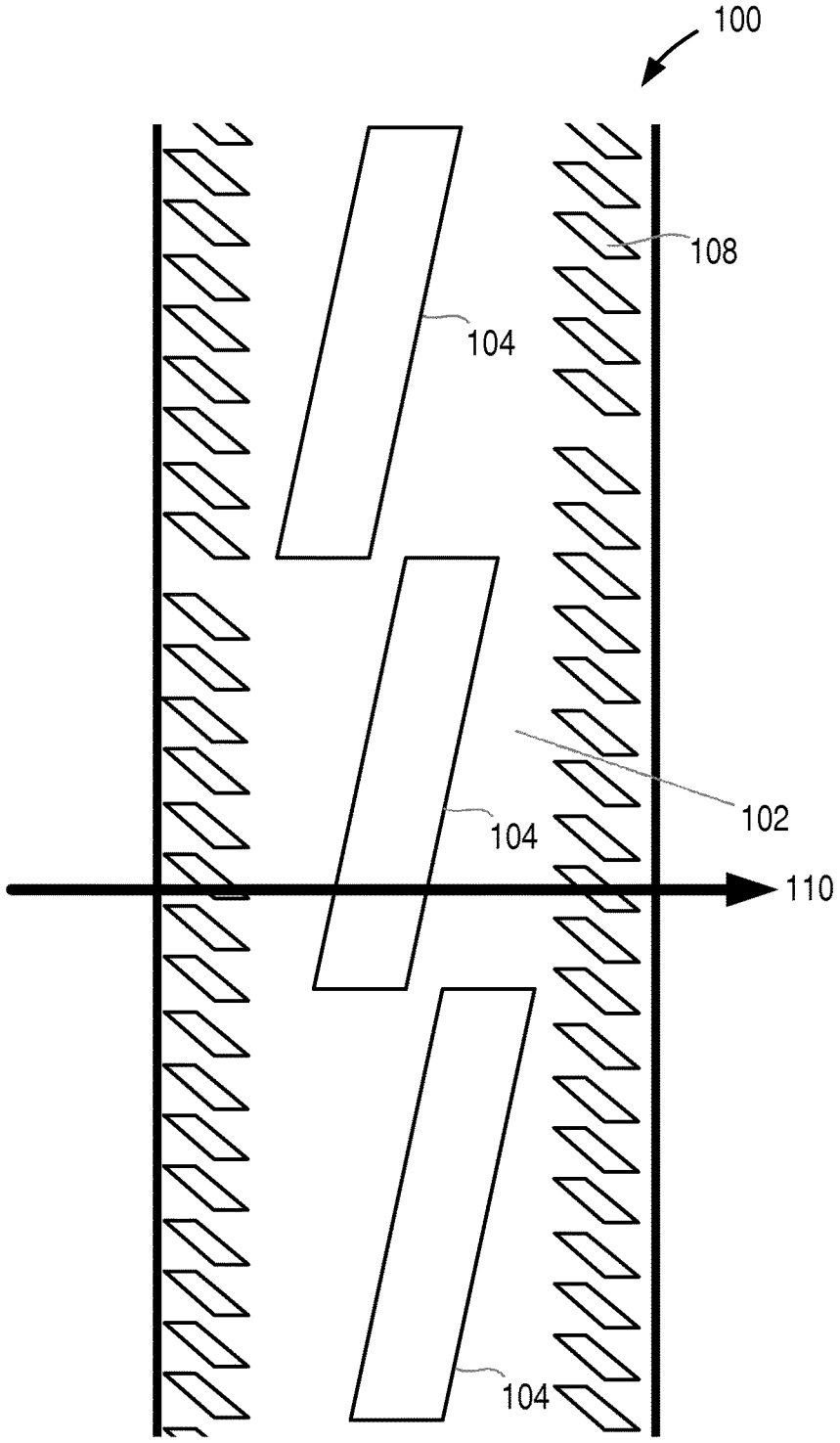
FIG. 1 shows an example of a dryer.

An example of a dryer is illustrated in FIG. 1 which shows a dryer 100 comprising a first surface 102 comprising at least one opening 104 through which air is forced during use to dry a printed media (not shown). The dryer may also contain recirculation holes 108. During use, printed media may be passed under the dryer in a direction such as the direction indicated by the arrow 110.

Figure 2:
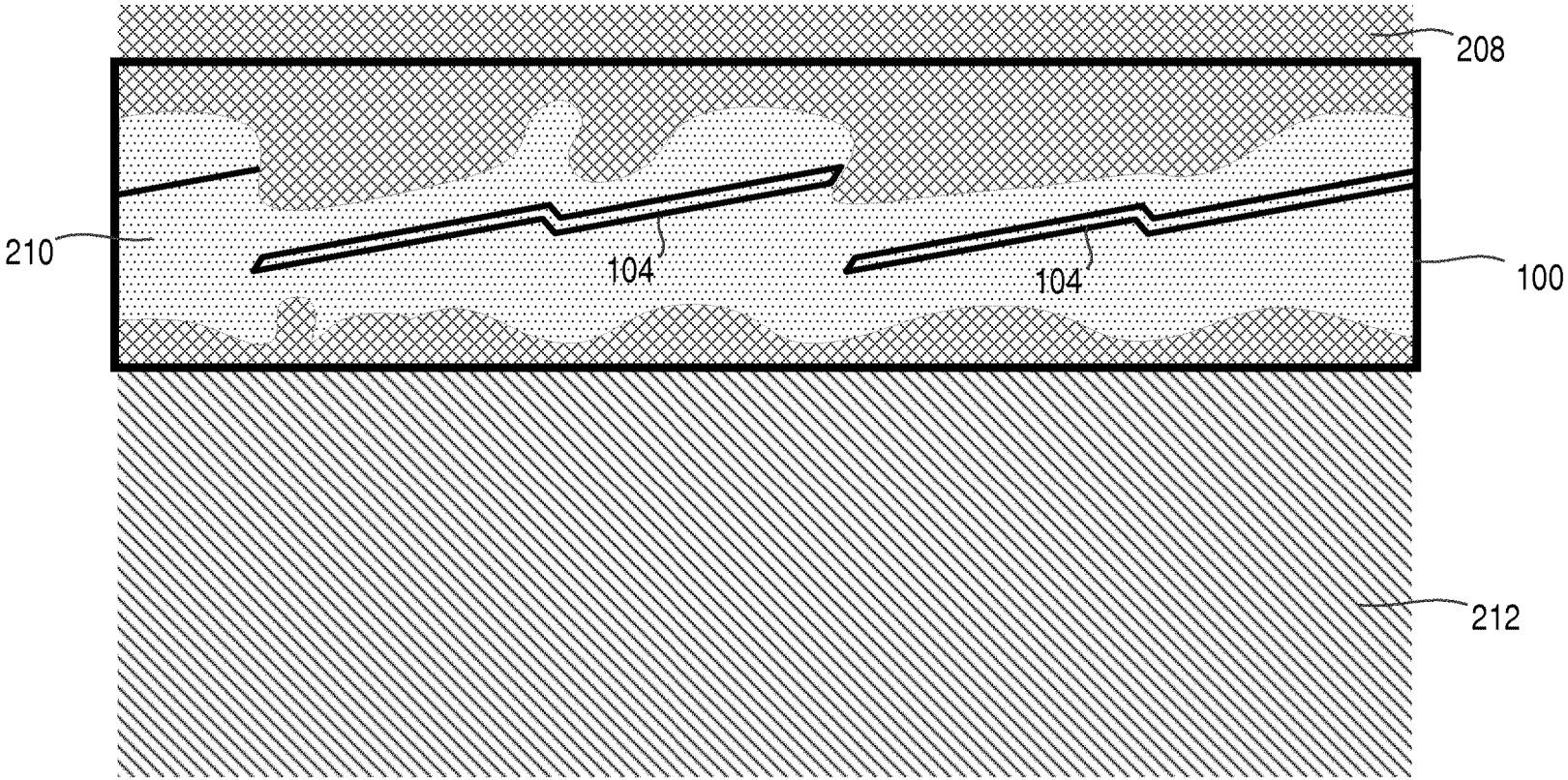
FIG. 2 shows a pressure map of the pressure created by an example dryer when in use.

When the dryer shown in the example of FIG. 1 is in use, a low pressure region may form below the openings 104. FIG. 2 shows an example pressure map overlain on an outline of an example dryer depicted in FIG. 1. The dryer 100 and the first surface 102 are represented by the box 100 in FIG. 2. The pressure map shows an example of the pressures that the dryer 100 may exert on a printed media as it passes under the dryer 100, moving in a downwards direction, from the top to the bottom of FIG. 2. Starting at the top of FIG. 2, the leading edge of the printed media firstly experiences a positive pressure (i.e. atmospheric pressure or above) in the shaded region 208. As the printed media moves down towards the openings 104, the pressure drops below atmospheric pressure in the second shaded region 210. Beyond the second region, and as the leading edge of the media exits the dryer, the pressure drops further; the third shaded region 212 of FIG. 2 indicates pressures, for example of less than around −70 Pa.

The result of the pressure drop experienced in such a dryer below the openings 104 can cause the leading edge of the printed media to rise up towards or into the openings. If the leading edge is not restrained downwards (for example by a pinch mechanism that holds the printed media in place before it enters the dryer), then this can lead to a media jam.

To prevent jams of this kind, some examples set out herein, include a dryer comprising a first surface which comprises at least one opening through which air is forced during use to dry a printed media. The dryer can further comprise a deflector having a second surface to change the direction of airflow passing through the at least one opening. The deflector guides the direction of the airflow such that it flows in a direction corresponding to the direction of travel of the printed media.

The use of the deflector to guide the airflow in this way can help prevent the formation of a low pressure region below the slits. The low pressure regions depicted in FIG. 2 can be created when the air from the openings hits the surface to be dried and divides into two airflows that travel approximately parallel to the surface in opposite directions. In the case of printed media moving in the direction 110 as indicated in FIG. 1, one airflow travels in the direction of travel of the media 110 under the dryer, and the second travels in the opposite direction to the direction of travel of the media (i.e. in the opposite direction to the arrow 110 in FIG. 1). It is the parting of the airstreams in this way that can cause the low pressure region. Furthermore, the airflow in the opposite direction to the direction of travel may further encourage the leading edge to rise up. The inclusion of a deflector in the example dryers described herein can reduce the creation of low pressure regions and the corresponding effects (e.g. media jams).

Figure 3:
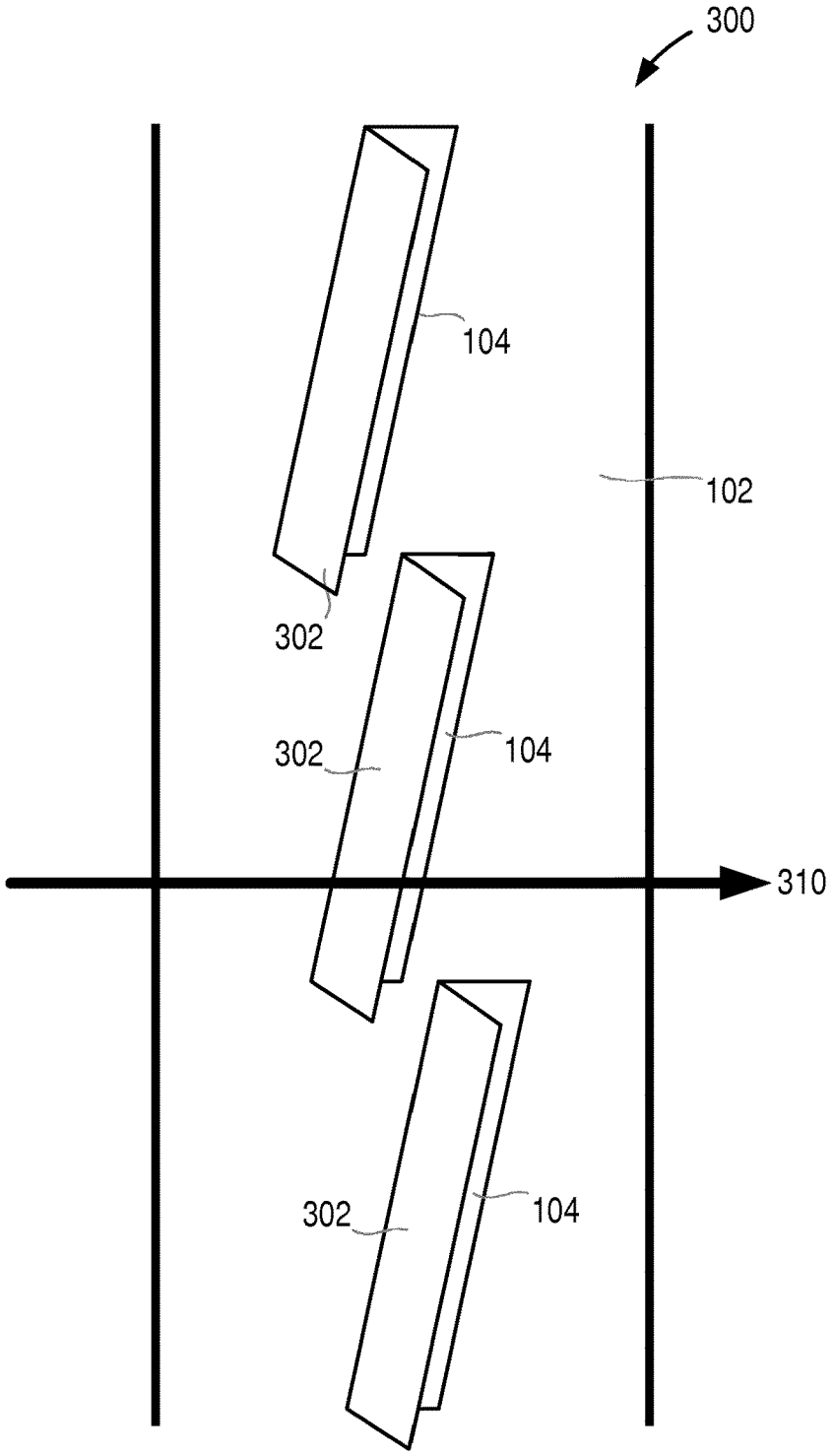
FIG. 3 shows an example dryer.

An example is illustrated in FIG. 3 which shows a dryer 300 with a first surface 102 and a plurality of openings 104. The openings 104 can be staggered such that, in combination, they span the full width of the first surface 102. In use, a printed media can be fed past (e.g. underneath) the dryer in the direction of the arrow 310.

It is noted that the use of three openings 104 in FIG. 3 is merely an example and in other examples, there may be a single opening, two openings or more than two openings.

According to some examples, the at least one opening 104 is elongated. For example, the at least one opening 104 may be a slit in the surface 102. According to other examples, the at least one opening 104 may be other shapes such as circular, square or oblong opening(s) in the surface 102.

In cases where the at least one opening 104 comprises two or more openings, in some examples, the two or more openings are the same shape, for instance they may both be slits. However, in other examples, the two or more openings may be different shapes, for instance a first opening may be circular whilst a second is slit shaped.

In some examples, the at least one opening 104 is positioned such that it spans the full width of the printed media to be dried. If the at least one opening 104 comprises two or more openings, then (as shown in the example in FIG. 3), in some examples, the two or more openings 104 can be positioned such that in combination, they span the full width of the printed media to be dried. For example, openings 104 may be staggered across the width of the media, or partially overlap.

The dryer 300 in the example of FIG. 3 also comprises three deflectors 302, each comprising a second surface to change the direction of air passing through the openings 104.

In one example the direction of the deflected airflow is orthogonal to the major axis of the openings (or slots) 104. In some examples it is not necessary for the guided airflow (i.e. the airflow guided by the deflector) to move parallel to the surface, rather media jams can be reduced if the deflector guides the airflow such that the average velocity vector of the airflow has a component in the direction of travel of the printed media.

Figure 4:
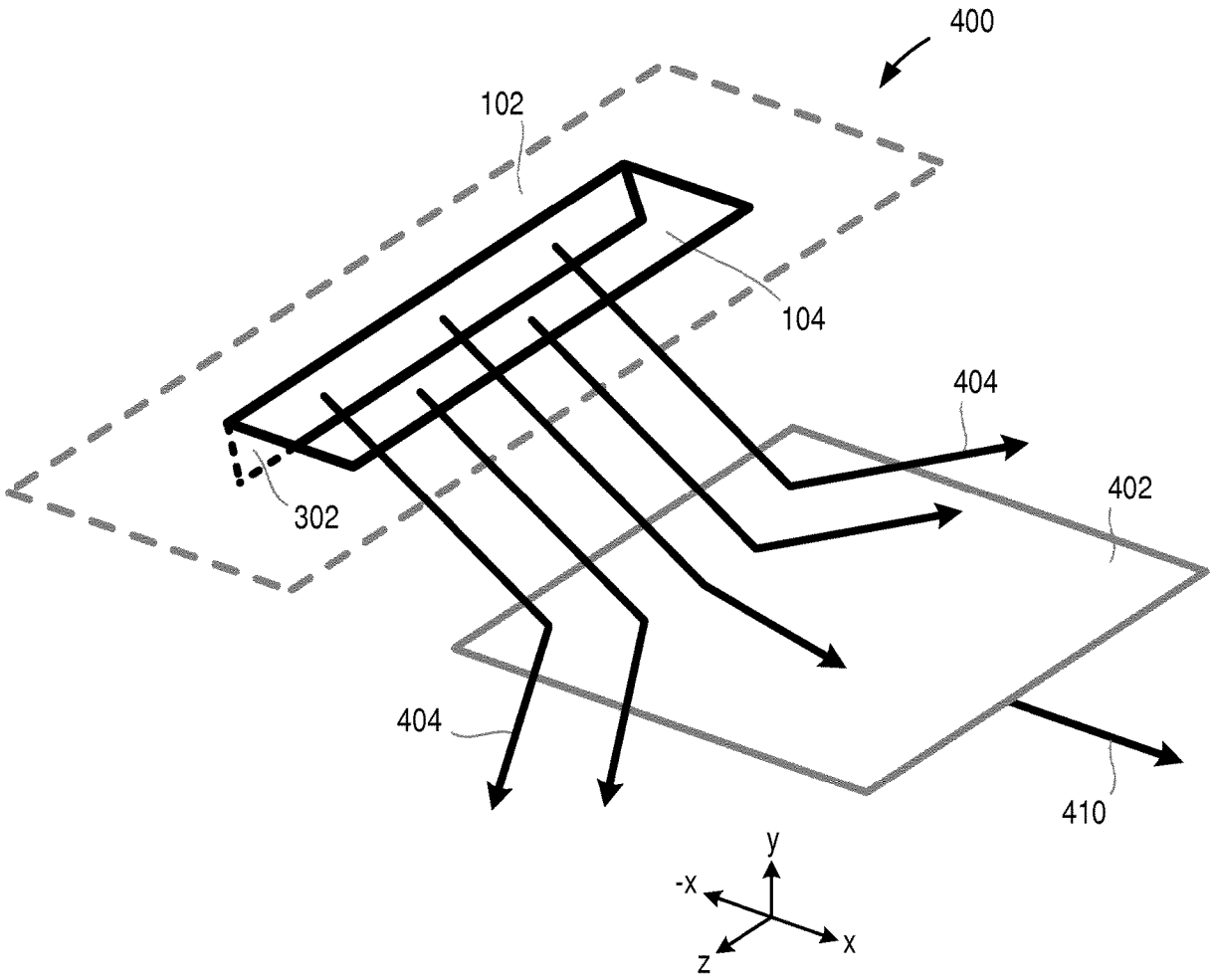
FIG. 4 shows an example of an airflow from an example dryer.

Example average velocity vectors are depicted in the example of FIG. 4, which shows a first surface 102, an opening 104, and a deflector 302 that are part of a dryer 400. When in use, printed media 402 moves under the dryer 400 in a direction indicated by the large arrow 410. Air 404 is forced under pressure through the opening 104 and is guided by the deflector 302 such that the air impinges on the printed media 402 and rebounds predominantly in the forward direction corresponding to the direction of travel 410 of the printed media 402. Although there is a degree of scatter in the direction of each individual air particle (for example, in the y and z directions indicated on FIG. 4), the deflector reduces airflow in the opposite direction to the direction of travel of the printed media (i.e. reduces airflow in the −x direction as indicated in FIG. 4). This has the effect of reducing the aforementioned low pressure region and reducing media (e.g. paper) jams without the need for a pinching mechanism, partial-vacuum or a lowering of the air speed through the openings 104. Thus, according to examples described herein, the use of a deflector can provide a solution to media jams caused by low pressure regions under a dryer with no or little increase in complexity, cost, or active parts.

In some examples, the deflector 302 can be part of the first surface 102. For example, the deflector 302 and the first surface 102 may be formed as a single unitary body or part, for example from a single sheet of material. In some examples, the deflector 302 is formed from a flap cut from the first surface to create the at least one opening 104. The flap can form the deflector 302 when it is opened at an angle to the first surface 102. The cuts made in the first surface to create the flap may be any shape; accordingly the deflector 302 may, for example, be semi-circular, or rectangular.

In another example, the deflector 302 can comprise a separate sheet of material that is fixed in place next to the openings 104. The deflector 302 may be fixed in place, for example, using an adhesive such as glue, mechanically attached with screws or a hinge mechanism, or welded in place.

The surface of the deflector 302 may be positioned at an angle to a plane of the first surface 102. The angle between the first surface 102 and the deflector 302 may be any angle between 0 and 90 degrees to the plane of the first surface 102. A range of angles and deflector lengths are possible and these are discussed in more detail with respect to FIG. 6 below.

In some examples, the deflector 302 may be flat. In other examples, the deflector 302 may be bent or curved.

In examples where the at least one opening 104 comprises two or more openings, the deflector 302 may guide the air from a single opening, or simultaneously from two or more openings. In other examples, there may be second or subsequent deflectors to guide the airflow from second or subsequent openings. In further examples, some openings may not have an adjacent deflector and airflow from these openings may flow unguided.

Figure 5:
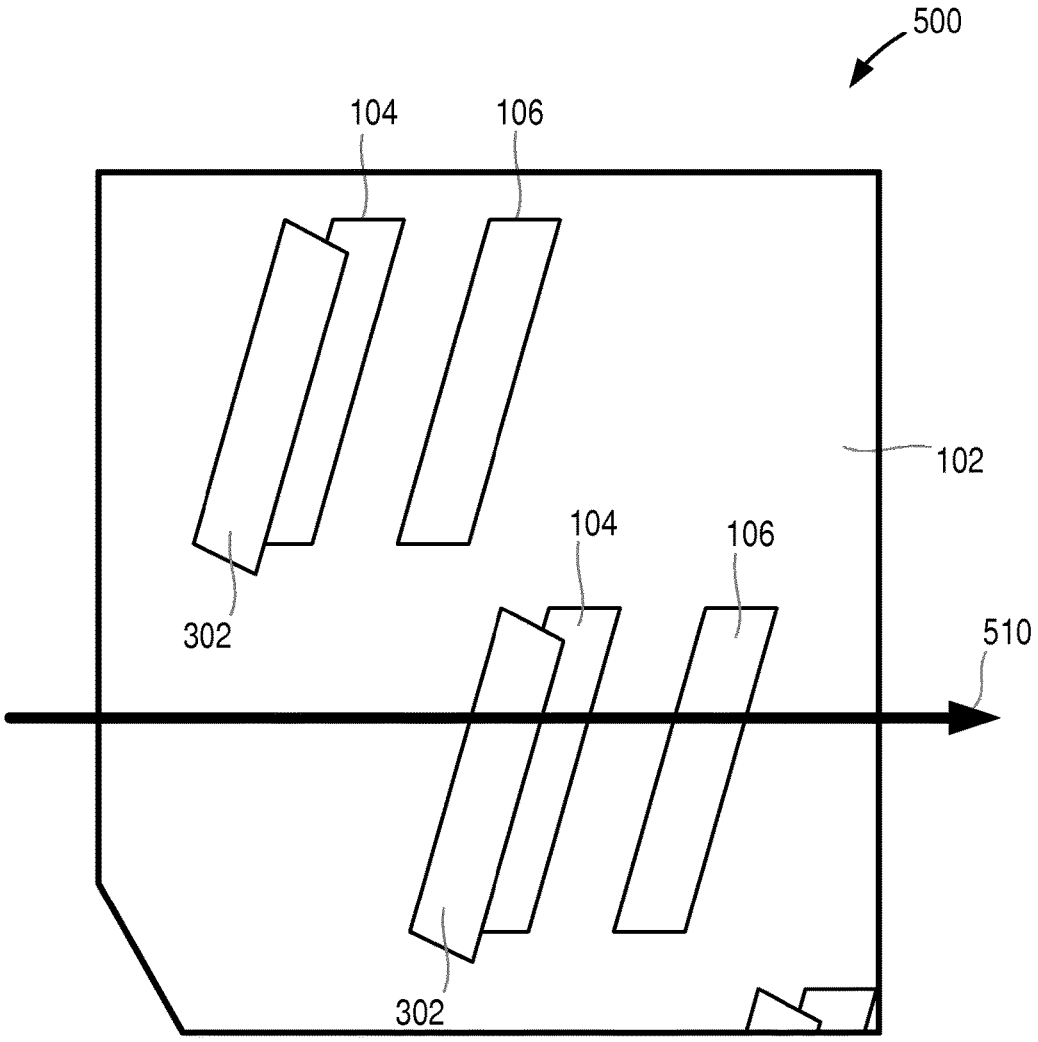
FIG. 5 shows another example of a dryer.

A further example is shown in FIG. 5 which shows a dryer 500 with a first surface 102 and two pairs of first and second openings 104 and 106. In use, a printed media is fed past (e.g. underneath) the dryer in the direction of the arrow 510. Air is forced under pressure through the openings 104 and 106 to impinge on and dry the printed media. The first and second openings 104 and 106 in each pair are elongated in the example of FIG. 5, and positioned parallel to one another on the first surface.

In the example of FIG. 5, the deflector 302 guides the direction of airflow from the first opening 104. In this example, there are two elongated slot-shaped openings, and the occurrence of media jams can be reduced (i.e. the media can be prevented from rising up) if a deflector is placed to guide airflow from the first opening 104. In this example, the first opening 104 is the opening on the upstream side with respect to the direction of travel of the printed media.

Figure 6:
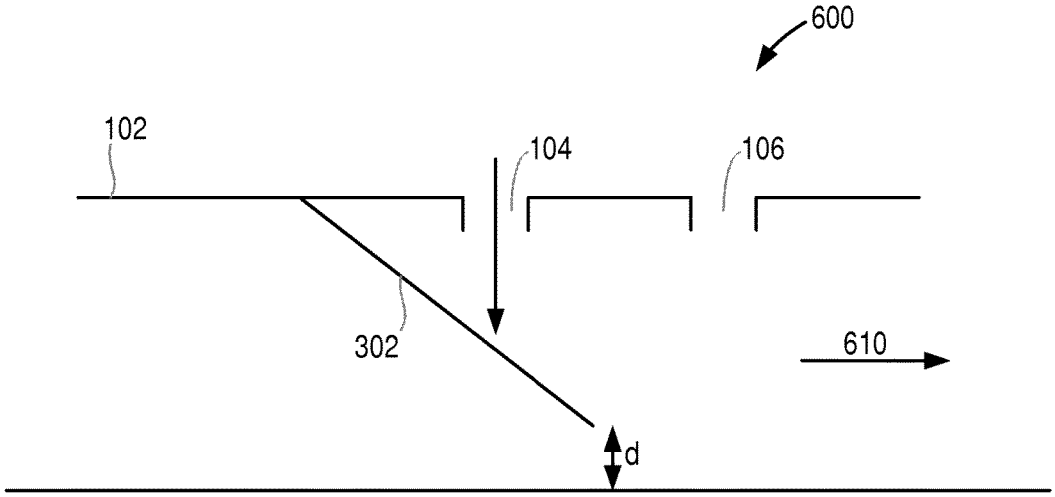
FIG. 6 shows another example of a dryer.

FIG. 6 shows a second example of a dryer 600 with a first surface 102, a first opening 104 and a second opening 106. In use, a printed media is fed past (e.g. underneath) the dryer in the direction of the arrow 610. In this example, a deflector 302 guides the airflow from the first opening 104. The length of the deflector 302 and the angle between the first surface 102 and the deflector 302 can be varied between different applications. In some examples, the chosen combination is set such that i) the lower edge of the deflector is at least a minimum distance, d, from the surface of the printed media and ii) the deflector 302 cuts through the airflow of the first opening 104. The distance d may be determined by the properties of the printed media and should be large enough such that the deflector does not come into contact with the media.

In some examples the dryers described above may be fully integrated in a printer. As such, in some examples, the first surface may form part of a larger surface or a larger component part that comprises additional components for printing, such as scanning carriages for holding ink cartridges and toner or rollers to move the printed media through the printer. In other examples, the dryer may be a separate dryer, for example an impingement dryer, that is attached to, or forms part of a print apparatus.

Therefore, according to some examples, there is a printer wherein a media is fed into the printer in a first direction, wherein the printer comprises a surface comprising a least one slot through which air is forced under pressure during use and a deflector to change a direction of airflow to correspond with the first direction.

In one example printer, the deflector is angled to a plane of the surface such that the deflector cuts across the airflow from the at least one slot. In another example, the deflector and the surface are formed as a single unitary body. The deflector can be formed from a flap cut from the surface to create the at least one slot.

In some examples, the media may be a lamina material or two dimensional sheet. For example, the media may be paper, webbing, fabric, plastic sheeting or any other media suitable for printing. In some examples the media may be printed by applying an agent to the media, for example, ink, dye or an adhesive such as glue.

As mentioned above, in some examples the deflector 302 does not necessarily change the direction of the airflow such that it flows parallel to the surface, rather the direction is changed such that the average velocity vector of the airflow has a component in the direction corresponding to the direction of travel of the printed media (i.e. the first direction). The effects of the examples herein can be provided so long as the deflector 302 changes the airflow such that it flows substantially in the first direction, for example such that the average velocity vector of the airflow has a component in the direction of travel of the printed media, or without permitting a significant flow with a velocity vector component in the counter direction to the direction of travel of the printed media through the printer.

Figure 7:
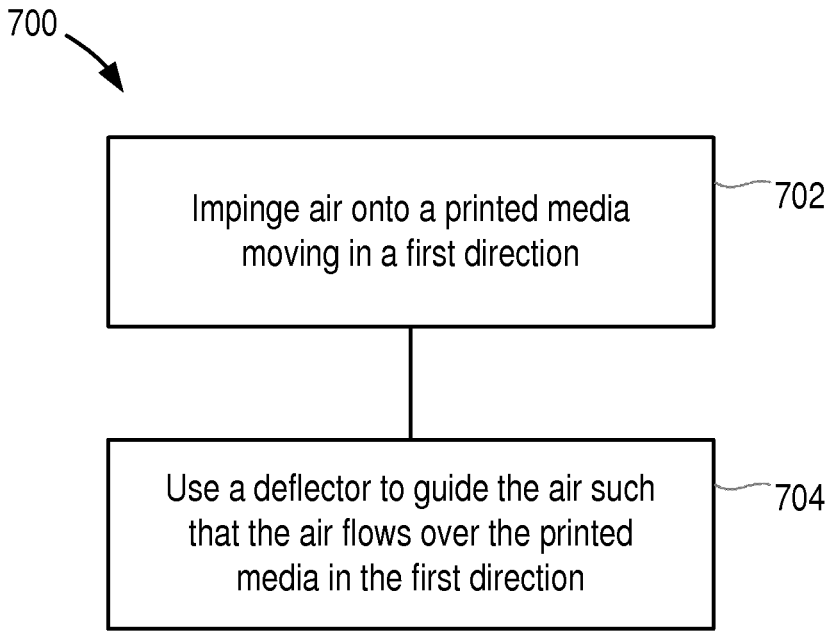
FIG. 7 shows an example of a method.

According to another example shown in FIG. 7, there is provided a method of drying printed media 700. The method comprises impinging air, for example hot air, onto a printed media moving in a first direction 702, and using a deflector 302 to guide the air such that it flows over the printed media in the first direction 704. In one example the method comprises guiding the airflow such that an average velocity vector of the airflow has a component in the first direction.

While the method, apparatus and related aspects have been described with reference to certain examples, various modifications, changes, omissions, and substitutions can be made without departing from the scope of the present disclosure. It is intended, therefore, that the method, apparatus and related aspects be limited only by the scope of the following claims and their equivalents. It should be noted that the above-mentioned examples illustrate rather than limit what is described herein, and that alternative implementations may be designed without departing from the scope of the appended claims.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A dryer comprising:

a first surface comprising an opening through which air is forced during use to dry a printed media, wherein the opening extends along an angled direction such that the opening is diagonal with respect to a direction of travel of the printed media; and a deflector comprising a second surface to change a direction of airflow of the air passing through the opening to guide the direction of the airflow toward the direction of travel of the printed media.

2. The dryer of claim 1, wherein the opening is to direct the airflow passing through the opening in a downward direction toward an upper surface of the printed media, and the deflector is to change the direction of the airflow from the downward direction to a different direction that is angled with respect to the downward direction.

3. The dryer of claim 1, wherein the opening is a first opening, the first surface further comprising a second opening, wherein the first and second openings are elongated and positioned parallel to one another on the first surface.

4. The dryer of claim 3, wherein the deflector is adjacent the first opening to guide the direction of the airflow from the first opening, and wherein the second opening is without an adjacent deflector and airflow from the second opening is unguided by a deflector adjacent the second opening.

5. The dryer of claim 1, wherein the airflow guided by the deflector has a velocity vector that has a component in the direction of travel of the printed media.

6. The dryer of claim 1, wherein the deflector and the first surface are formed as a single unitary body.

7. The dryer of claim 1, wherein the opening is diagonal with respect to a boundary edge of the first surface.

8. The dryer of claim 1, wherein the deflector is angled with respect to a plane of the first surface.

9. The dryer of claim 1, wherein the deflector is angled to a plane of the first surface such that the deflector cuts across the airflow from the opening.

10. The dryer of claim 3, wherein the second opening extends along the angled direction such that the second opening is diagonal with respect to the direction of travel of the printed media.

11. The dryer of claim 10, wherein the first and second openings are staggered across a width of the printed media.

12. A method of drying printed media, the method comprising:

directing air through an opening in a surface of a dryer, the air passing through the opening toward an upper surface of a printed media moving in a first direction, wherein the opening extends along an angled direction such that the opening is diagonal with respect to the first direction; and using a deflector to guide the air such that a portion of an airflow of the air flows over the printed media in the first direction.

13. The method of claim 12, wherein the opening is a first opening, and the surface of the dryer further comprises a second opening that extends along the angled direction such that the second opening is diagonal with respect to the first direction, and wherein the deflector is adjacent the first opening to change a direction of the airflow passing through the first opening, and wherein the second opening is without an adjacent deflector and airflow from the second opening is unguided by a deflector adjacent the second opening.

14. The method of claim 12, further comprising:

forming the deflector from a flap cut from the surface to crate the opening.

15. The method of claim 12, further comprising:

guiding, using rollers, the printed media along the first direction, wherein the air is directed onto the upper surface of the printed media as the printed media is guided by the rollers under the dryer.

16. A printer comprising:

a dryer comprising:

a surface comprising a slot through which air is directed toward an upper surface of a printed media as the printed media is passed under the dryer in a direction of travel of the printed media, wherein the slot extends along an angled direction such that the slot is diagonal with respect to the direction of travel of the printed media; and a deflector to change a direction of airflow of the air passing through the slot to correspond with the direction of travel of the printed media.

17. The printer of claim 16, wherein the deflector is angled with respect to a plane of the surface such that the deflector cuts across the airflow from the slot.

18. The printer of claim 16, wherein the deflector and the surface are formed as a single unitary body.

19. The printer of claim 16, wherein the slot is a first slot, and the surface further comprises a second slot that extends along the angled direction such that the second opening is diagonal with respect to the direction of travel of the printed media.

20. The printer of claim 19, wherein the deflector is adjacent the first slot to change the direction of the airflow passing through the first slot, and wherein the second slot is without an adjacent deflector and airflow from the second slot is unguided by a deflector adjacent the second slot.

* * * * *